US010814518B2

(12) United States Patent
Gerstenberger et al.

(10) Patent No.: US 10,814,518 B2
(45) Date of Patent: Oct. 27, 2020

(54) CHAINSAW

(71) Applicant: ANDREAS STIHL AG & CO. KG, Waiblingen (DE)

(72) Inventors: Oliver Gerstenberger, Ditzingen (DE); Helmut Zimmermann, Berglen (DE); Andreas Fricker, Donaueschingen (DE)

(73) Assignee: ANDREAS STIHL AG & CO. KG, Waiblingen (DE)

( * ) Notice: Subject to any disclaimer, the term of this patent is extended or adjusted under 35 U.S.C. 154(b) by 0 days.

(21) Appl. No.: 15/937,433

(22) Filed: Mar. 27, 2018

(65) Prior Publication Data

US 2018/0281225 A1 Oct. 4, 2018

(30) Foreign Application Priority Data

Apr. 4, 2017 (EP) ..... 17400017

(51) Int. Cl.

| | |
|---|---|
| ***B27B 17/14*** | (2006.01) |
| ***B27B 17/02*** | (2006.01) |
| ***B27B 17/08*** | (2006.01) |
| ***B27B 17/00*** | (2006.01) |

(52) U.S. Cl.

CPC ..... *B27B 17/14* (2013.01); *B27B 17/02* (2013.01); *B27B 17/0008* (2013.01); *B27B 17/08* (2013.01); *Y10T 83/7226* (2015.04); *Y10T 83/7239* (2015.04)

(58) Field of Classification Search

CPC ..... B27B 17/02; B27B 17/14; B27B 17/0008; B27B 17/08; Y10T 83/7226; Y10T 83/7239

USPC ..... 30/386, 381; 83/814, 816, 574

See application file for complete search history.

(56) References Cited

U.S. PATENT DOCUMENTS

| | | | | |
|---|---|---|---|---|
| 3,636,995 | A * | 1/1972 | Newman | B27B 17/14 30/386 |
| 4,117,594 | A * | 10/1978 | Arbuckle | B27B 17/0033 30/381 |
| 4,981,129 | A * | 1/1991 | Osterman | B27B 17/02 125/21 |
| 4,999,918 | A | 3/1991 | Schliemann et al. | |
| 5,491,899 | A | 2/1996 | Schliemann et al. | |

(Continued)

FOREIGN PATENT DOCUMENTS

| | | |
|---|---|---|
| DE | 3843459 A1 | 6/1990 |
| EP | 2774733 A1 | 9/2014 |

*Primary Examiner* — Laura M Lee

(74) *Attorney, Agent, or Firm* — Lucas & Mercanti, LLP; Klaus P. Stoffel

(57) ABSTRACT

A chainsaw having a drive motor. The chainsaw has a fixed part and a movable part. The guide bar is retained on the fixed part in a manner braced between the fixed part and a tensioning element. The movable part is shiftable in a longitudinal direction with respect to the fixed part in order to tension the saw chain with the tensioning element released. The chainsaw has a stop face and a tensioning face. At least one additional contact face that is firmly connected to the fixed part in the longitudinal direction and at least one additional contact face that is firmly connected to the movable part in the longitudinal direction are arranged between the stop face and the tensioning face. All the contact faces lie one after another in the flux of force from the tensioning element to the fixed part.

14 Claims, 8 Drawing Sheets

(56) References Cited

U.S. PATENT DOCUMENTS

| | | | | |
|---|---|---|---|---|
| 6,237,228 | B1 * | 5/2001 | Moody | B27B 17/14 30/381 |
| 6,782,627 | B2 * | 8/2004 | Hermes | B27B 17/14 30/386 |
| 7,434,502 | B2 * | 10/2008 | Keeton | B27B 17/14 30/386 |
| 9,713,881 | B2 | 7/2017 | Zimmermann et al. | |
| 2006/0207111 | A1 * | 9/2006 | Sugishita | B27B 17/14 30/386 |
| 2014/0250702 | A1 * | 9/2014 | Zimmermann | B27B 17/14 30/386 |
| 2018/0186027 | A1 * | 7/2018 | McRoberts | B27B 17/00 |

* cited by examiner

CHAINSAW

CROSS-REFERENCE TO RELATED APPLICATIONS

The present application claims priority of EP 17 400 017.4, filed Apr. 4, 2017, the priority of this application is hereby claimed and this application is incorporated herein by reference.

BACKGROUND OF THE INVENTION

The invention relates to a chainsaw of the generic type.

DE 38 43 459 A1 discloses a chainsaw having a guide bar, wherein the guide bar is retained on the housing at one end in a manner braced between the housing and a tensioning part. In order to tension the saw chain, the guide bar is adjustable in the longitudinal direction by means of a chain tensioning device with the tensioning part released. At least one of the mutually facing faces between the guide bar end and the housing or the tensioning part has been treated in a manner increasing the coefficient of friction. As a result, with the same clamping force, greater forces can act on the mounting without any adjustment of the guide bar occurring.

It has been found that, in chainsaws having a quick clamping mechanism for the saw chain, only small forces that act on the guide bar can be transmitted to the housing. In chainsaws in which large forces that act on the guide bar can be transmitted to the housing, by contrast, the tensioning of the saw chain is complicated and time-consuming.

SUMMARY OF THE INVENTION

The invention is based on the object of creating a chainsaw of the generic type, which allows quick and easy tensioning of the saw chain and high force transmission from the guide bar to the housing.

Provision is made for the chainsaw to have a fixed part and a movable part, wherein the fixed part comprises the drive motor and the movable part comprises the guide bar. The guide bar is retained on the fixed part at one end in a manner braced between the fixed part and a tensioning element. The movable part in order to tension the saw chain is shiftable in a longitudinal direction of the movable part with respect to the fixed part with the tensioning element released. The chainsaw has a stop face that is firmly connected to the fixed part in the longitudinal direction, and a tensioning face of the tensioning element, said tensioning face being firmly connected to the fixed part in the longitudinal direction. The tensioning face of the tensioning element can be for example an end face of a tensioning nut or an end face of a housing cover. The chainsaw has at least two contact faces that are firmly connected to the movable part in the longitudinal direction of the guide bar. One contact face of the at least two contact faces bears against the stop face and a further contact face of the at least two contact faces bears against the tensioning face. At least one additional contact face that is firmly connected to the fixed part in the longitudinal direction and at least one additional contact face that is firmly connected to the movable part in the longitudinal direction are arranged between the stop face and the tensioning face. All the contact faces lie one after another in the flux of force from the tensioning element to the fixed part.

The expressions "movable part" and "fixed part" do not in the present case designate individual components, but assemblies which can be formed from a plurality of components that are connected together.

Provision is advantageously made for the tensioning element to be tensioned against the fixed part. Advantageously, the tensioning element is tensioned against the fixed part via the clamping elements and the guide bar.

When the contact faces of the movable part bear against the stop face, the tensioning face and/or the contact faces of the fixed part, frictional-contact faces are formed. The frictional-contact faces are consequently formed from contacting faces. At the frictional-contact faces, with the tensioning element tensioned, frictional forces are transmitted between the fixed part and the movable part in the longitudinal direction. As a result of the number of contact faces of the fixed part and of the movable part being increased, the number of frictional-contact faces also increases. With the increase in the number of frictional-contact faces, the maximum force that acts on the movable part and is to be transmitted to the fixed part increases. Even under high loads on the guide bar that arise during operation of the chainsaw, said guide bar does not shift relative to the fixed part. The maximum frictional force that is transmissible results from the level of the clamping force generated by the tensioning element, the number of frictional-contact faces, and the level of the coefficient of friction of the frictional-contact faces. The higher the clamping force, the greater the number of frictional-contact faces, and the higher the coefficient of friction of the frictional-contact faces, the greater the frictional force that is maximally transmissible from the movable part to the fixed part. Given a correspondingly large number of frictional-contact faces, it is also possible, as a result, for frictional-contact faces with a comparatively low coefficient of friction, in particular frictional-contact faces without a coating that increases the coefficient of friction, to be provided.

With the tensioning element released, the movable part, in particular the guide bar, can be shifted quickly and easily in the longitudinal direction with respect to the fixed part, in particular the drive motor. Since the flux of force between the tensioning face and abutment face of the chainsaw is interrupted, it is not possible for any frictional force to be transmitted between the movable part and the fixed part. Therefore, the movable part can be shifted in the longitudinal direction with respect to the fixed part and the saw chain guided on the guide bar can be tensioned quickly and easily. It is also quickly and easily possible to replace a saw chain as a result. Advantageously, the fixed part comprises a housing of the chainsaw. The fixed part advantageously comprises a housing cover, in particular a sprocket cover of the chainsaw. In an alternative embodiment, provision may also be made for the movable part to comprise the housing cover.

Advantageously, in each case at least four, in particular at least eight, additional contact faces that are firmly connected to the fixed part and additional contact faces that are firmly connected to the movable part are arranged between the stop face and tensioning face. As the number of contact faces of the movable part and of the fixed part that are in contact with one another increases, the maximum frictional force which can be transmitted from the movable part to the fixed part increases.

Provision is advantageously made for the contact faces to extend parallel to the longitudinal plane of the guide bar with the tensioning element tensioned. In a state of the chainsaw set down on horizontally extending, level ground, the longitudinal plane of the guide bar extends through the longitudinal direction of the guide bar and is perpendicular to the ground. Advantageously, the contact faces are arranged alongside one another in a section plane perpendicular to the longitudinal plane. As a result of the compact arrangement of the contact faces alongside one another, an increase in the maximum frictional forces to be transmitted between the movable part and fixed part can occur with only a small installation space.

Advantageously, the chainsaw comprises at least one first clamping element and a second clamping element. Contact faces that are firmly connected to the fixed part in the longitudinal direction are formed on the first clamping element, and contact faces that are firmly connected to the movable part in the longitudinal direction are formed on the second clamping element. The first clamping element and the second clamping element are in mutual contact at their contact faces in the tensioned state of the tensioning element. The flux of force from the tensioning element to the fixed part extends through the first clamping element, the second clamping element and the movable part. Via the additional frictional-contact faces formed by the first clamping element and the second clamping element, it is possible for a greater maximum frictional force to be transmitted between the movable part and the fixed part.

Advantageously, the clamping elements each have a width measured perpendicularly to the longitudinal plane, wherein the width of the clamping elements with the tensioning element released is in each case greater than the width of the clamping elements with the tensioning element tensioned. As a result of the clamping elements springing out transversely to the longitudinal plane, the movable part and the fixed part are pretensioned with respect to one another even with the tensioning element partially released, and so a small amount of frictional-force transmission between the movable part and fixed part is possible. If the movable part is shifted in the longitudinal direction and the saw chain retensioned as a result, the movable part maintains its position on account of the frictional forces present between the movable part and the fixed part, without any action on the part of the operator. Once the target position of the movable part has been reached, the movable part can be clamped firmly between the fixed part and the tensioning element without having to be retained in the target position by the operator.

Provision is advantageously made for the clamping elements each to comprise at least one plate extending parallel to the longitudinal plane. A plate of the first clamping element advantageously has two contact faces that are firmly connected to the fixed part in the longitudinal direction. A plate of the second clamping element advantageously has two contact faces that are firmly connected to the movable part in the longitudinal direction. Advantageously, the clamping elements each comprise at least two plates extending parallel to the longitudinal plane. In this case, the at least two plates of the first clamping element and the at least two plates of the second clamping element advantageously engage in one another in a lamellar manner. As a result, a lamellar effect is established between the first clamping element and the second clamping element. As a result of the alternate engagement in one another of the in each case at least two plates of the first clamping element and of the second clamping element, the number of frictional-force-transmitting frictional-contact faces increases while the clamping force that proceeds from the tensioning element and acts perpendicularly to the longitudinal plane remains the same. As a result, the maximum frictional force to be transmitted between the movable part and the fixed part increases. Since each clamping element comprises at least two plates, the number of individual parts is reduced compared with a design made up of individual plates and assembly is simplified.

Advantageously, the width of the plates of the clamping elements is in each case less than the length and less than the height of the plates. The plates are advantageously configured as thin plates, the width of which is only a fraction of the length and height. As a result, the installation space which is required in the tensioning direction can be kept small. Advantageously, the plates are resilient. Preferably, the first clamping element and/or the second clamping element are folded. In particular in the case of a clamping element which has at least two plates, the fold results in the plates springing out. As a result of the thin, resilient and/or folded configuration of the plates, the plates are able to spring out. Preferably, the first clamping element and/or the second clamping element are made of stainless steel.

With an increasing number of plates engaging in one another in a lamellar manner, the force which acts on the stop face, the tensioning face and on the contact faces between the movable part and the fixed part is reduced. As a result, not only is the maximum force to be transmitted between the movable part and fixed part increased, but the wear at the contact faces and at the stop face and the tensioning face is also considerably reduced. The plates can in this case be formed on two or more clamping elements.

Provision is advantageously made for a bolt to project through the first clamping element, and for the first clamping element to be retained securely on the fixed part in the longitudinal direction via the bolt. Advantageously, the first clamping element is retained on the fixed part in a play-free manner in the longitudinal direction by means of a spring. As a result of the play-free retention of the first clamping element by means of the spring, the saw chain can be tensioned precisely. As a result, a relative movement, resulting from the play between the bolt and the clamping element, between the fixed part and movable part can be avoided during the tensioning process of the saw chain and before the final bracing together of the parts.

Advantageously, a magnet for retaining the movable part on the fixed part with the tensioning element released is arranged in the fixed part. As a result, the movable part, in particular the guide bar, is secured to the fixed part even when the tensioning element is fully released. The chainsaw can be assembled and/or the saw chain retensioned without the guide bar having to be held by the operator. As a result, easy assembly of the chainsaw and quick and easy retensioning of the saw chain is ensured.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
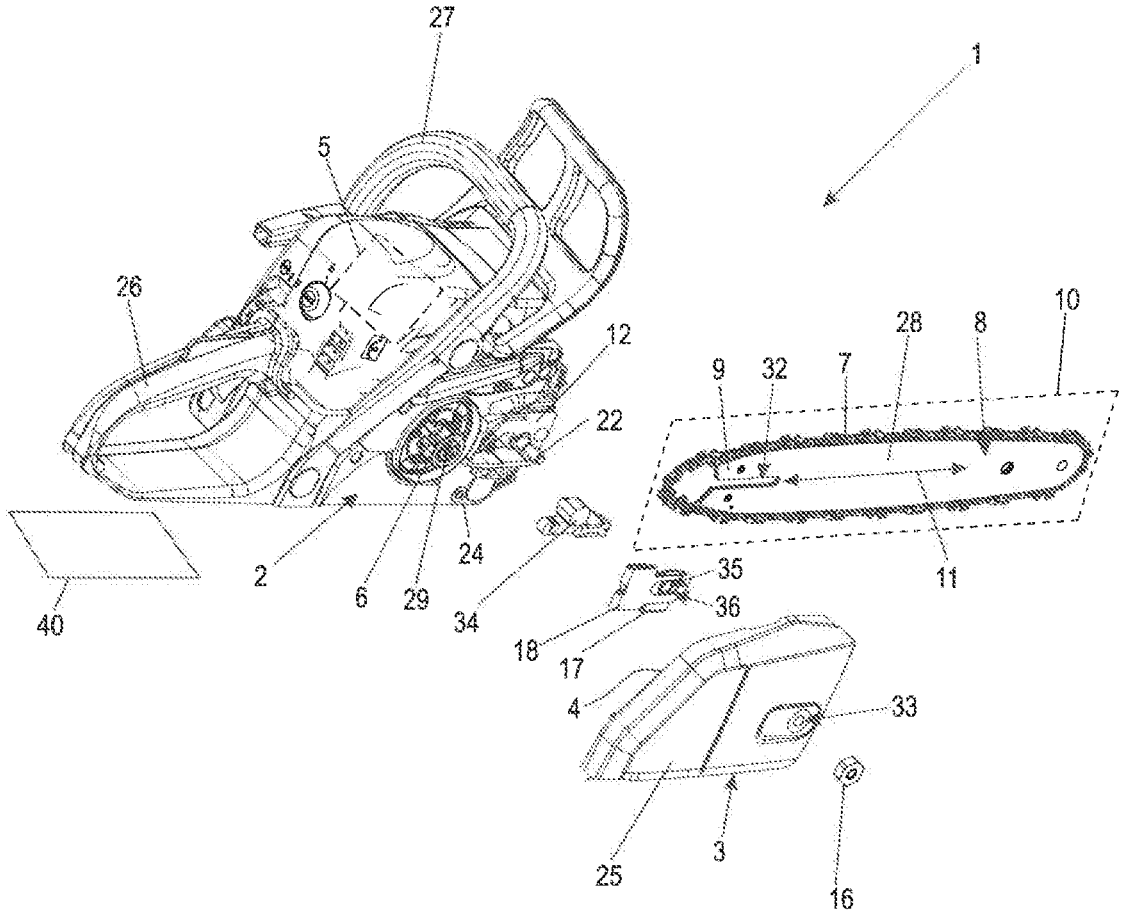
FIG. 1 shows an exploded illustration of a chainsaw having a tensioning device with clamping elements with two plates.

The chainsaw 1 shown in FIG. 1 has a housing 24 to which a rear handle 26 and a bale handle 27 for guiding the chainsaw 1 are secured. On the opposite side of the housing 24 from the rear handle 26, a guide bar 28 projects forward. A saw chain 7 is arranged in a circulating manner on the guide bar 28, said saw chain 7 being driven by a schematically illustrated drive motor 5. The drive motor 5 is in particular a combustion engine, advantageously a two-stroke engine or a mixture-lubricated four-stroke engine. However, the drive motor 5 can also be an electric motor, which can be powered via a rechargeable battery or via a connection cable.

The drive motor 5 drives a driveshaft 29, which projects out of the housing 24. Arranged on the driveshaft 29 is a drive means 6, which is configured as a pinion in the exemplary embodiment. The drive means 6 serves to drive the saw chain 7, which is guided via the drive means 6 during operation. Formed on the housing 24 is a stop face 12 against which the guide bar 28 bears in the assembled state of the chainsaw 1. The stop face 12 can in this case be formed on the housing 24 itself or on a side plate arranged on the housing 24. Screwed into the housing 24 is a bolt 22. In the exemplary embodiment, the bolt 22 has two threaded portions which are separated from one another by an encircling collar (see FIG. 6). The portion facing the housing 24 is screwed into the housing 24. The guide bar 28 is secured to the outwardly projecting portion. In order to be secured to the bolt 22, the guide bar 28 has a receiving opening 32, which is configured as a slot in the exemplary embodiment. For securing the guide bar 28, a housing cover 25 is provided, which has an opening 33 for the bolt 22. The housing cover 25 is intended to be fastened to the bolt 22 via a nut 16. The housing cover 25 is part of a tensioning element 3 which has on its end face a tensioning face 4 which is directed toward the guide bar 28. In the exemplary embodiment, the tensioning element 3 is formed by the housing cover 25 and the nut 16. In the clamped state, the guide bar 28 is retained in a clamped manner between the abutment face 12 of the housing 24 and the tensioning face 4 of the tensioning element 3. Provision may also be made for the nut 16 to form the tensioning element 3 and for an end face of the nut to form the tensioning face 4. This is provided in particular when the housing cover 25 is firmly connected to the guide bar 28 in the longitudinal direction 10.

As shown in FIG. 1, the chainsaw 1 comprises a fixed part 2 and a movable part 8. In the exemplary embodiment, the fixed part 2 of the chainsaw 1 comprises the housing 24, the housing cover 25 and the tensioning element 3. The rear handle 26 and the bale handle 27 of the chainsaw 1 are advantageously part of a handle housing which is connected to the fixed part 2 in a vibration-damping manner via antivibration elements. The movable part 8 comprises the guide bar 28 in the exemplary embodiment. The guide bar 28 has a longitudinal direction 11 which corresponds to the longitudinal axis of the guide bar 28. The longitudinal direction 11 extends centrally through the guide bar 28 in a horizontal plane in a state of the chainsaw 1 set down on level, horizontal ground 40. The guide bar 28 has a longitudinal plane 10 which contains the longitudinal direction 11 and is perpendicular to the ground in a state of the chainsaw 1 set down on level, horizontal ground 40. The movable part 8 can be shifted in the longitudinal direction 11 with respect to the fixed part 2. If the guide bar 28 is braced, the guide bar 28 is retained at its end 9 between two components of the fixed part 2, in the exemplary embodiment between the housing 24 and the housing cover 25. In the exemplary embodiment, the guide bar is braced transversely to the longitudinal plane 10, in particular perpendicularly to the longitudinal plane 10. The housing 24, the housing cover 25 and the tensioning element 3 are connected firmly together in the longitudinal direction 11 of the guide bar 28. The housing cover 25 and the tensioning element 3 are connected firmly to the fixed part 2 in the longitudinal direction 11 of the guide bar 28. The guide bar 28 is firmly connected to the movable part 8 in its longitudinal direction 11. In an advantageous, alternative embodiment, the movable part can comprise the housing cover 25. In this case, the nut 16 is part of the fixed part 2 and the end face of the nut 16 forms the tensioning face 4.

As shown in FIG. 1, a first clamping element 17 and a second clamping element 18 are arranged between the stop face 12 and the tensioning face 4. The first clamping element 17 has an opening 35, through which the bolt 22 projects in the assembled state of the guide bar 28. The clamping element 17 is firmly connected to the housing 24 in the longitudinal direction 11 via the bolt 22. The second clamping element 18 is screwed together with the guide bar 28 and as a result firmly connected to the guide bar in the longitudinal direction 11. The second clamping element 18 has an opening 36, which is configured as a slot in the exemplary embodiment. The bolt 22 projects through the opening 36 in the second clamping element 18. Since the opening 36 is configured as a slot, the second clamping element 18 is shiftable in the longitudinal direction 11 with respect to the housing 24.

As FIG. 1 shows, the chainsaw 1 comprises a magnet device 34 which is fastened to the housing 24. By means of the magnet device 34, the guide bar 28 is magnetically retained on the housing 24 during the assembly and tensioning operation. As a result, the guide bar 28 does not additionally have to be retained on the housing 24 by the operator during the assembly operation. As a result of the magnet device 34, the assembly of the guide bar 28 on the housing 24 and/or the retensioning of the saw chain 7 by shifting the guide bar 28 in the longitudinal direction 11 relative to the housing 24 is simplified.

The following reference signs, defined terms and mentioned advantages apply in a corresponding manner to all the exemplary embodiments.

Figure 2:
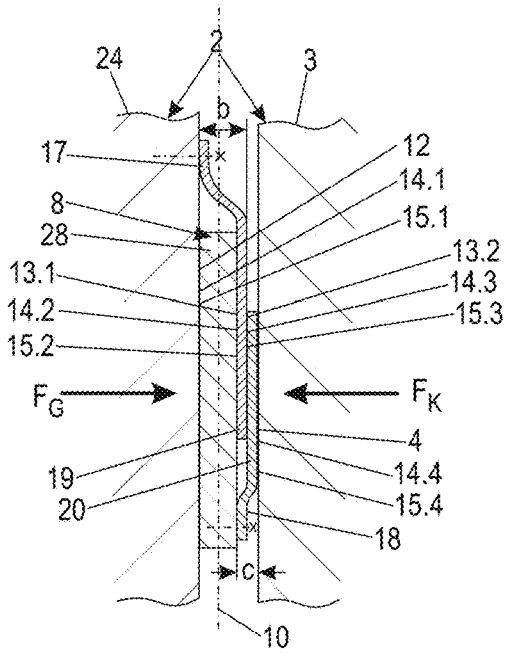
FIG. 2 shows a schematic sectional illustration of clamping elements with one plate in a tensioned state.

FIG. 2 shows a schematic sectional illustration of a detail of the chainsaw 1 in the tensioned state, in which the fixed part 2, the movable part 8 and the first clamping element 17 and the second clamping element 18 are illustrated. In the exemplary embodiment, the fixed part 2 comprises the housing 24 and the tensioning element 3, and the movable part 8 comprises the guide bar 28. The first clamping element 17 has a thin plate 19 and is fastened to the housing 24 such that it is firmly connected to the housing 24 in the longitudinal direction 11. The second clamping element 18 has a thin plate 20 and is fastened to the guide bar 28 such that it is firmly connected to the guide bar 28 in the longitudinal direction 11.

As FIG. 2 shows, the chainsaw 1 has a stop face 12 that is firmly connected to the fixed part 2 in the longitudinal direction 11, and a tensioning face 4 that is firmly connected to the fixed part 2 in the longitudinal direction 11, and contact faces 13.1 and 13.2 that are firmly connected to the fixed part 2 in the longitudinal direction 11. In the exemplary embodiment, the stop face 12 is formed on the housing 24 and the tensioning face 4 is formed on the tensioning element 3. The plate 19 of the clamping element 17 has two longitudinal sides, which extend parallel to the longitudinal plane 10 and on each of which a contact face 13.1, 13.2 is formed. In the exemplary embodiment, the chainsaw 1 has the four contact faces 14.1, 14.2, 14.3, 14.4 that are firmly connected to the movable part 8 in the longitudinal direction 11. Formed on each of the longitudinal sides of the guide bar 28, which extend parallel to the longitudinal plane 10, is a contact face 14.1 and 14.2, respectively. The plate 20 of the clamping element 18 likewise has two longitudinal sides, which extend parallel to the longitudinal plane 10 and on each of which a contact face 14.3 and 14.4, respectively, is formed.

In the tensioned state of the guide bar 28, the contact faces 13.1 and 13.2 firmly connected to the fixed part 2 in the longitudinal direction 11 and the stop face 12 and the tensioning face 4 are in contact with the contact faces 14.1, 14.2, 14.3, 14.4 firmly connected to the movable part 8 in the longitudinal direction 11 and in the process are in contact with one another in pairs in a frictional-contact face 15.1, 15.2, 15.3, 15.4. Thus, the mutually contacting stop face 12 and the contact face 14.1 of the guide bar 28 form the frictional-contact face 15.1, the contact face 13.1 of the clamping element 17 and the contact face 14.2 of the guide bar 28 form the frictional-contact face 15.2, the contact face 13.2 of the clamping element 17 and the contact face 14.3 of the clamping element 18 form the frictional-contact face 15.3, and the tensioning face 4 and the contact face 14.4 of the clamping element 18 form the frictional-contact face 15.4.

As shown in FIG. 2, when the guide bar 28 is braced, starting from a tightening torque of the nut 16, not shown in FIG. 2, (FIG. 1) on the tensioning element 3, a clamping force FK is applied which acts perpendicularly to the longitudinal plane 10. In the process, the tensioning element 4 is tensioned against the second clamping element 18, the first clamping element 17, the guide bar 28 and against the housing 24 with the clamping force FK, wherein the housing 24 counteracts the clamping force FK with a force FG via the bolt 22. In the process, the contact faces 13.1, 13.2 that are firmly connected to the fixed part 2 in the longitudinal direction 11, the abutment face 12 and the tensioning face 4 lie alternately one after another in a flux of force with the contact faces 14.1, 14.2, 14.3, 14.4 firmly connected to the movable part 8 in the longitudinal direction 11. In each of the frictional-contact faces 15.1, 15.2, 15.3, 15.4, a contact force acts in the process in each case perpendicularly to the frictional-contact face 15.1, 15.2, 15.3, 15.4, the level of which corresponds substantially to that of the clamping force FK acting on the tensioning face 4. As a result, a frictional force, which counteracts any shifting of the movable part 8 with respect to the fixed part 2, acts in each frictional-contact face 15.1, 15.2, 15.3, 15.4.

Via the frictional forces acting on the frictional-contact faces 15.1, 15.2, 15.3, 15.4, it is possible for forces to be transmitted between the fixed part 2 and the movable part 8. The frictional force corresponds to the product of the contact force acting in the frictional-contact face 15.1, 15.2, 15.3, 15.4 and the coefficient of friction prevailing in the frictional-contact face 15.1, 15.2, 15.3, 15.4. With each additional frictional-contact face 15.1, 15.2, 15.3, 15.4, the maximum force that is transmissible between the fixed part 2 and the movable part 8 also increases, without the movable part 8 shifting relative to the fixed part 2.

Figure 3:
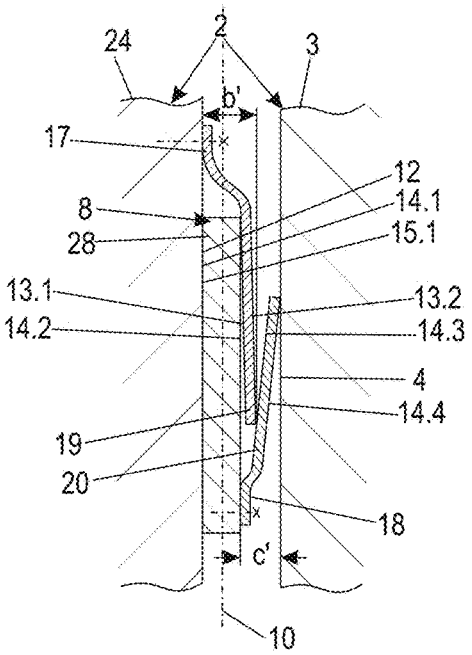
FIG. 3 shows the arrangement from FIG. 2 in an untensioned state.

As shown in FIGS. 2 and 3, in the braced state of the guide bar 28, the first clamping element 17 has a width b measured perpendicularly to the longitudinal plane 10, and the second clamping element has a width c measured perpendicularly to the longitudinal plane 10. If the tensioning element 3 has been released, the clamping elements 17, 18 spring out in the direction perpendicular to the longitudinal plane 10. As a result, the width b' of the clamping element 17 with the tensioning element 3 released is greater than the width b of the clamping element 17 with the tensioning element 3 tensioned. The width c' of the clamping element 18 with the tensioning element 3 released is also greater than the width c of the clamping element 18 with the tensioning element 3 tensioned. In the exemplary embodiment, with the tensioning element 3 tensioned, all the contact faces 13.1, 13.2, 14.1, 14.2, 14.3, 14.4 and the abutment face 12 and the tensioning face 4 extend parallel to the longitudinal plane 10 of the movable part 8. If the tensioning element 3 has been partially or completely released, the clamping elements 17, 18 spring out and the contact faces 13.1, 13.2, 14.3, 14.4 of the plates 19, 20 extend obliquely to the longitudinal plane 10.

FIG. 3 shows the arrangement with the nut 16 (FIG. 1) partially loosened. As a result, the tensioning element 3 is not tensioned firmly against the first clamping element 18. In the exemplary embodiment, the guide bar 28, the clamping elements 17, 18 and the tensioning element 3 are now only in point contact with one another. In one advantageous exemplary embodiment, the size of the frictional-contact faces 15.1, 15.2, 15.3, 15.4 and the contact force in the frictional-contact faces 15.1, 15.2, 15.3, 15.4 is reduced in each case. Only the frictional-contact face 15.1 between the abutment face 12 and the guide bar 28 persists, since the magnet device 34, not shown in FIG. 3, retains the guide bar 28 magnetically on the abutment face 12 even with the tensioning element 3 released.

The contact faces 13.1, 13.2 and 14.3, 14.4 are arranged on the principle of a multi-disk clutch. The contact faces 13.1, 13.2 that are firmly connected to the fixed part 2 in the longitudinal direction 11 are in mutual contact alternately with the contact faces 14.3, 14.4 that are firmly connected to the movable part 8 in the longitudinal direction 11, and lie one after another in the flux of force between the tensioning face 4 and abutment face 12. In advantageous exemplary embodiments, the arrangement of the plates 19, 20 of the clamping elements 17, 18 can differ from the exemplary embodiment according to FIGS. 2 and 3. Advantageously, the principle of a multi-disk clutch is maintained.

Figure 4:
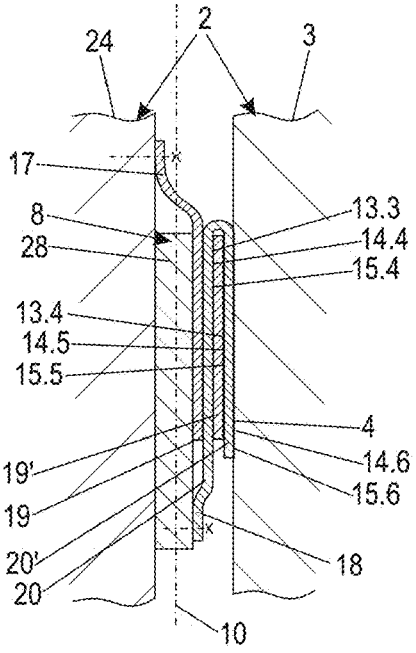
FIG. 4 shows a schematic sectional illustration of clamping elements with two plates in a tensioned state.

FIG. 4 shows a schematic sectional illustration of one exemplary embodiment of the chainsaw 1, which has a first clamping element 17 and a second clamping element 18. The difference from the exemplary embodiment in FIG. 2 is that the clamping element 17 has two plates 19, 19' and the clamping element 18 has two plates 20, 20'. The two plates 19, 19' of the clamping element 17 and the two plates 20, 20' of the clamping element 18 engage in one another in a lamellar manner. In the process, the stop face 12, the tensioning face 4 and the contact faces 13.1, 13.2, 13.3, 13.4, firmly connected to the fixed part 2 in the longitudinal direction 11, of the plates 19, 19' are alternately in contact with the contact faces 14.1, 14.2, 14.3, 14.4, 14.5, 14.6 that are firmly connected to the movable part 8 in the longitudinal direction 11, and form the frictional-contact faces 15.1, 15.2, 15.3, 15.4, 15.5, 15.6.

The number of frictional-contact faces 15.1, 15.2, 15.3, 15.4, 15.5, 15.6 of the exemplary embodiment shown in FIG. 4 has been increased, compared with the exemplary embodiment in FIG. 2, from four frictional-contact faces 15.1, 15.2, 15.3, 15.4 to six frictional-contact faces 15.1, 15.2, 15.3, 15.4, 15.5, 15.6. With the increase in the number from four frictional-contact faces to six frictional-contact faces, the maximum frictional force that acts between the fixed part 2 and the movable part 8 is increased by up to about 50%. As a result, the maximum force that is transmissible between the fixed part 2 and the movable part 8 is also increased by up to about 50%.

Figure 5:
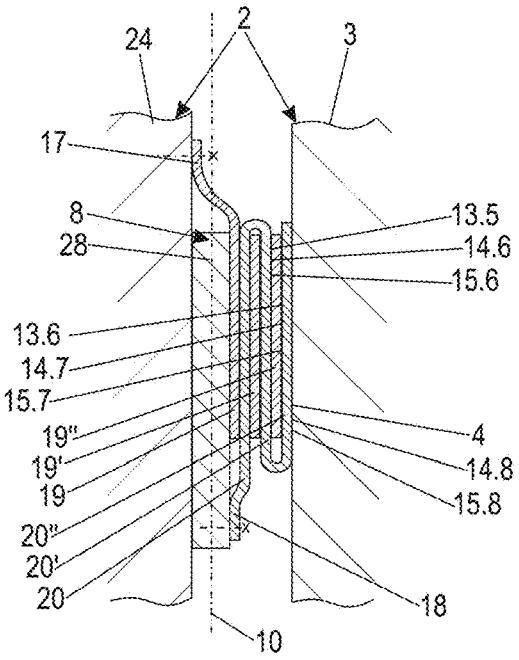
FIG. 5 shows a schematic sectional illustration of clamping elements with three plates in a tensioned state.

FIG. 5 shows a schematic sectional illustration of one exemplary embodiment of the chainsaw 1, in which the clamping element 17 has three plates 19, 19', 19" and the clamping element 18 has three plates 20, 20', 20". Compared with the exemplary embodiment in FIG. 4, the chainsaw 1 has two additional contact faces 13.5, 13.6 that are firmly connected to the fixed part 2 in the longitudinal direction 11, two additional contact faces 14.7, 14.8 that are firmly connected to the movable part 8 in the longitudinal direction 11, and two additional frictional-contact faces 15.7, 15.8. With the increase in the number from four frictional-contact faces 15.1, 15.2, 15.3, 15.4 in FIG. 2 to eight frictional-contact faces 15.1, 15.2, 15.3, 15.4, 15.5, 15.6, 15.7, 15.8, the maximum frictional force that acts between the fixed part 2 and the movable part 8 is increased by up to about 100% compared with the exemplary embodiment in FIG. 2. As a result, the maximum force that is transmissible between the fixed part 2 and the movable part 8 is also increased by up to about 100%. In further advantageous exemplary embodiments, the clamping elements 17, 18 can each also comprise four or more plates 19 and 20.

Figure 6:
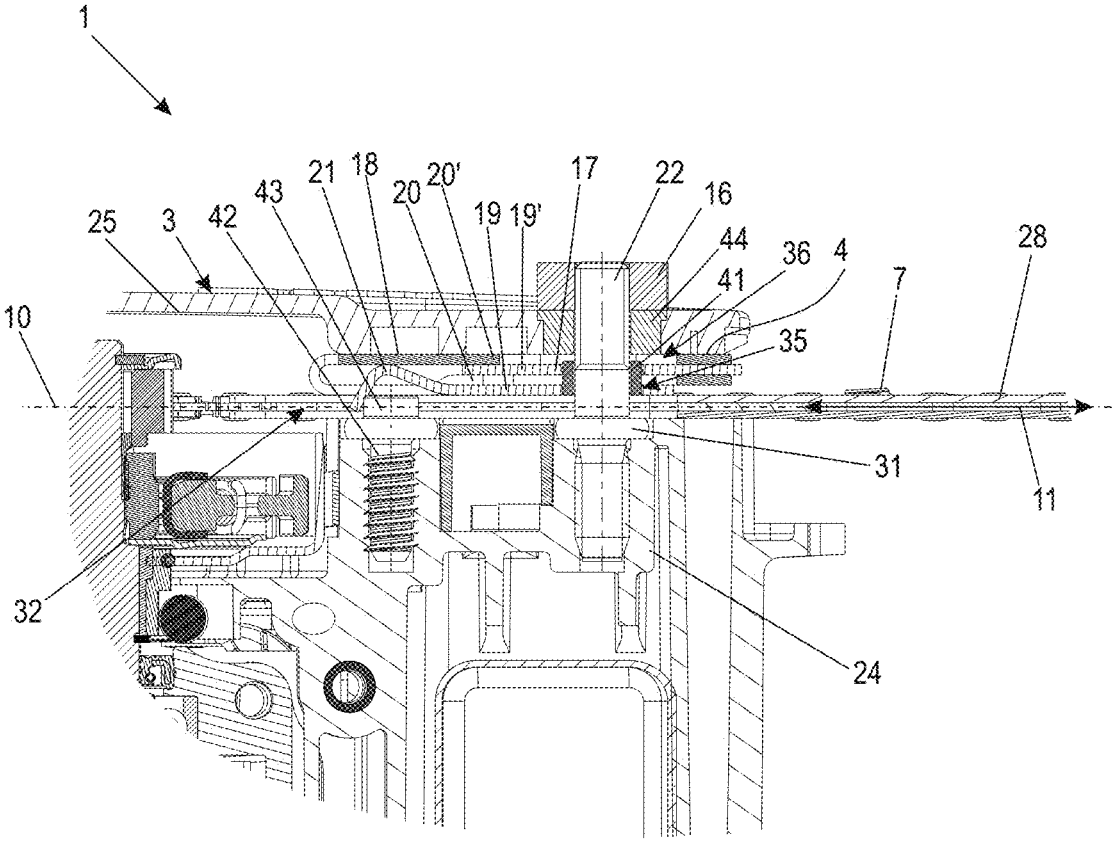
FIG. 6 shows a sectional illustration of a detail of the chainsaw from FIG. 1.

FIG. 6 shows the chainsaw 1 in the tensioned state, in which the guide bar 28 with the saw chain 7 are tensioned between the stop face 12 of the housing 24 and the tensioning face 4 of the tensioning element 3. Fastened to the guide bar 28 is the second clamping element 18, which has two plates 20, 20' in the exemplary embodiment. Formed on each of the plates 20, 20' are two contact faces 14.3, 14.4, 14.5, 14.6 as per the design in FIG. 4. In the exemplary embodiment according to FIG. 6, the second clamping element 18 has been screwed to the guide bar 28. A sleeve 41 is arranged in the opening 35 of the clamping element 17, wherein, in the exemplary embodiment, the sleeve 41 has been fitted in the opening 35 of the clamping element 17. The bolt 22 projects through the sleeve 41 and the clamping element 17, such that the clamping element 17 is firmly connected to the housing 24 in the longitudinal direction 11. Screwed into the housing 24 is a screw 42 with a screw head 43, wherein the screw head 43 of the screw 42 projects into the receiving opening 32 of the guide bar 28. Formed on the plate 20 of the first clamping element 17 is a spring 21 which has the shape of a bulge of the plate 20, said bulge being directed away from the longitudinal plane 10 transversely to the longitudinal plane 10. Already in an only partially braced state of the guide bar 28, the spring 21 bears against the screw head 43 of the screw 42 and braces the clamping element 17 against the bolt 22 in the longitudinal direction 11 via the sleeve 41. As a result, the radial play between the sleeve 41 and the bolt 22 is overcome and the bolt bears against the sleeve 41 in a defined manner on that side of the sleeve 41 that faces the spring. As a result, undesired shifting of the clamping element 17 in the longitudinal direction 11 with respect to the bolt 22 and the housing 24 during the tensioning operation is avoided. In an advantageous embodiment, the spring 21 can also be configured as a separate spring.

As shown in FIG. 6, in the exemplary embodiment, a sleeve 44 has been injection-molded in the housing cover 25. The tensioning face 4 is formed on the housing cover 25. The bolt 22 projects through the sleeve 44, wherein the nut 16 on the bolt 22 is braced against the sleeve 44. In the process, the guide bar 28 is clamped between the tensioning element 3 and the housing 24. The bolt 22 projects through an opening 36 of the clamping element 18, wherein the opening 36 is configured as a slot. As a result, the clamping element 18 and the guide bar 28 are shiftable in the longitudinal direction 11 with respect to the bolt 22 and the housing 24 with the nut 16 loosened and thus the tensioning element 3 released. The in each case two plates 19, 19', 20, 20' of the clamping elements 17, 18 engage in one another in a lamellar manner and form four additional frictional-contact faces 15.1, 15.2, 15.3, 15.4 (see FIG. 4). As a result, compared with a chainsaw 1 without clamping elements, the maximum frictional forces that act between the fixed part 2 and the movable part 8 are increased by up to 100%.

Figure 7:
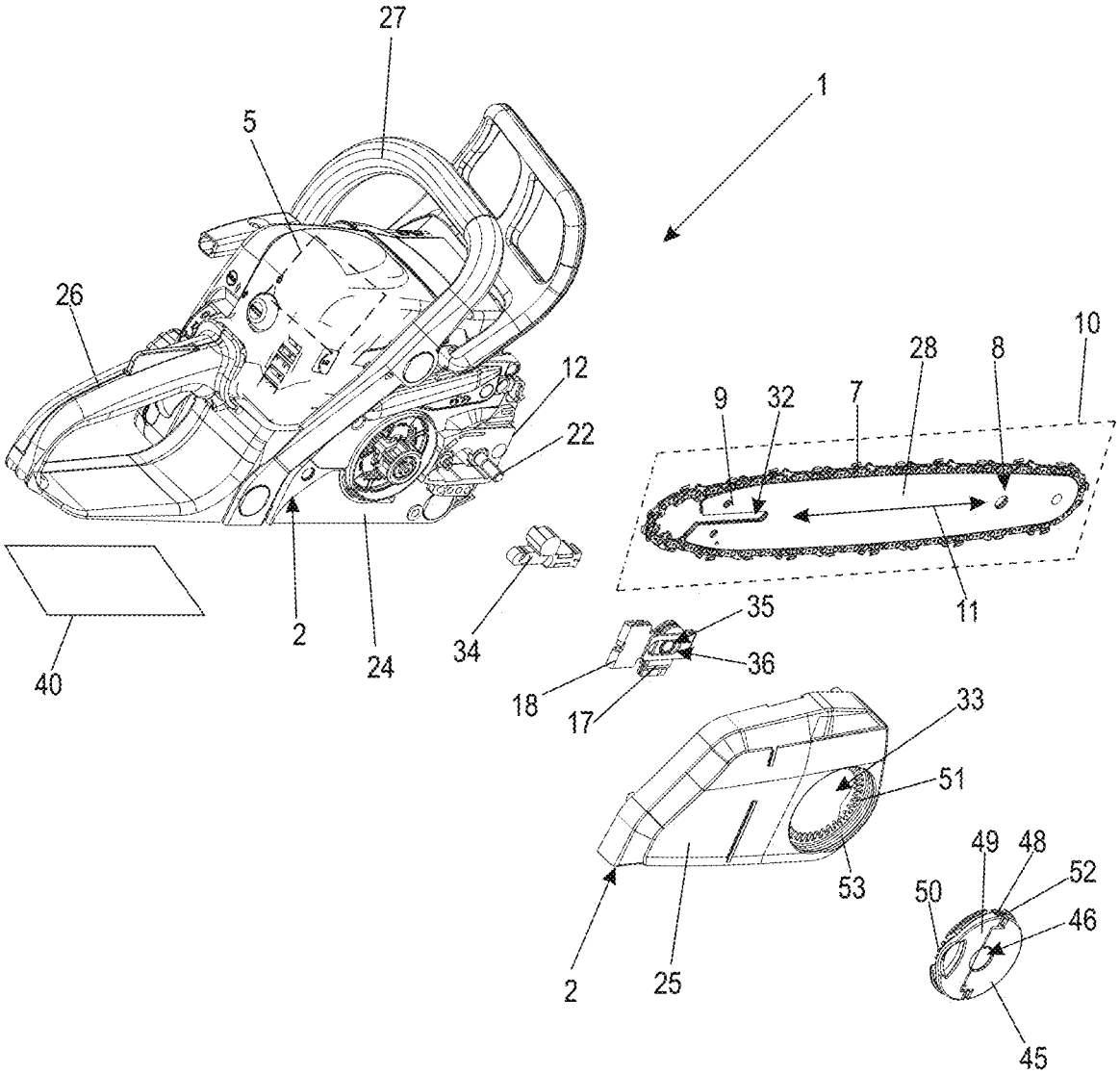
FIG. 7 shows an exploded illustration of a chainsaw having clamping elements with three plates and a tool-free tensioning device.

FIG. 7 shows a further exemplary embodiment of the chainsaw 1, which differs is from the exemplary embodiment shown in FIG. 1 by way of the design of the clamping elements 17, 18 and by way of the embodiment of the operating element 46, which is provided instead of the nut 16. The first clamping element 17 and the second clamping element 18 each comprise three plates 19, 19', 19', 20, 20', 20" (see FIGS. 11 and 12).

Figure 8:
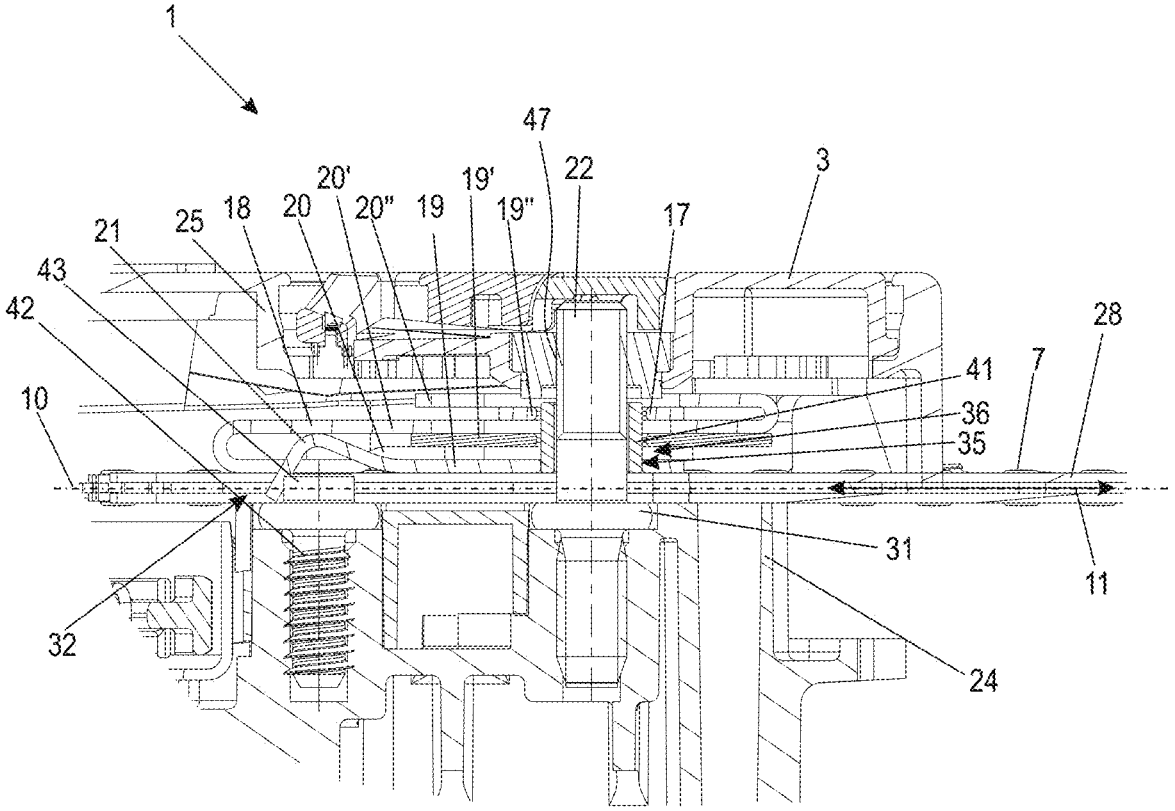
FIG. 8 shows a sectional illustration of a detail of the chainsaw from FIG. 7.

In the exemplary embodiment, the operating element 46 has a rotary disk 45 with a pivoting handle 49. The rotary disk 45 has substantially the shape of a round disk. The rotary disk 45 has, on its outer periphery, a retaining rib 52 extending in the circumferential direction. The rotary disk 45 is retained captively, via its retaining rib 52, in a retaining groove 53 formed in the opening 33 of the housing cover 25. In order to brace the housing cover 25 against the guide bar 28 and the housing 24, the rotary disk 45 is screwed onto the bolt 22 with a thread 47 (FIG. 8). The rotary disk 45 comprises a pivoting handle 49 which is pivotable at a joint 48 on the rotary disk 45. In order to rotate the rotary disk 45, the pivoting handle 49 can be pivoted outward. The rotation of the rotary disk 45 on the bolt 22 by means of the pivoting handle 49 allows the guide bar 28 to be braced without the use of a tool.

The clamping forces FK that arise during the bracing of the rotary disk 45 are transmitted from the guide bar 52 of the rotary disk 45 to the guide slot 53 of the housing cover. In the exemplary embodiment, the housing cover 24 is clamped against the guide bar 28 and the housing 24. In order to avoid undesired detachment of the rotary disk 45 from the bolt 22, tooth elements 50 are formed on the rotary disk 45, said tooth elements 50 being pushed into a toothing 53 formed on the opening 33 of the housing cover 24 when the pivoting handle 49 is pivoted back. The tooth elements 50 engage in the toothing 51 in a form-fitting manner, and so undesired detachment of the rotary disk 45 is prevented.

FIG. 8 shows the thread 47 of the rotary disk 45, said thread being formed, in the exemplary embodiment, on a nut injection-molded into the rotary disk 45. The tensioning face 4 is not shown in the section plane in FIG. 8. As the sectional illustration, shown in FIG. 8, of a detail of the exemplary embodiment shown in FIG. 7 shows, in the exemplary embodiment according to FIG. 7, clamping elements 17, 18 that each have three plates 19, 19', 19" and 20, 20', 20", respectively, are provided. As a result of the use of three plates 19, 19', 19", 20, 20', 20" per clamping element 17, 18, the chainsaw 1 has eight frictional-contact faces with the tensioning means 3 tensioned. As a result, compared with a chainsaw without clamping elements 17, 18, the maximum frictional force that acts between the fixed part 2 and the movable part 8 can be increased by up to 150%.

Figure 9:
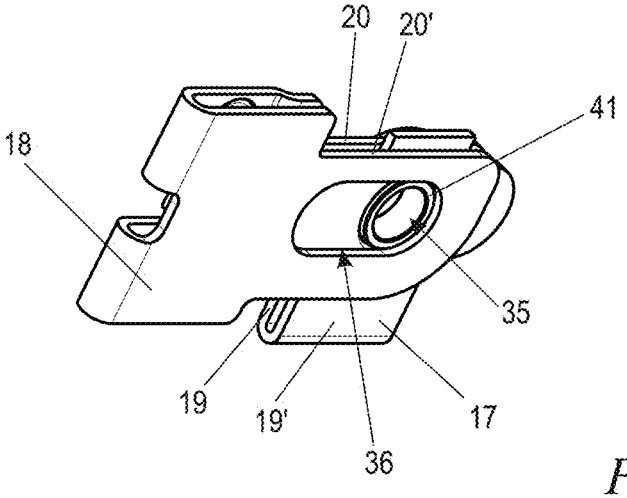
FIG. 9 shows a perspective illustration of clamping elements, engaging in one another, with two plates.
Figure 10:
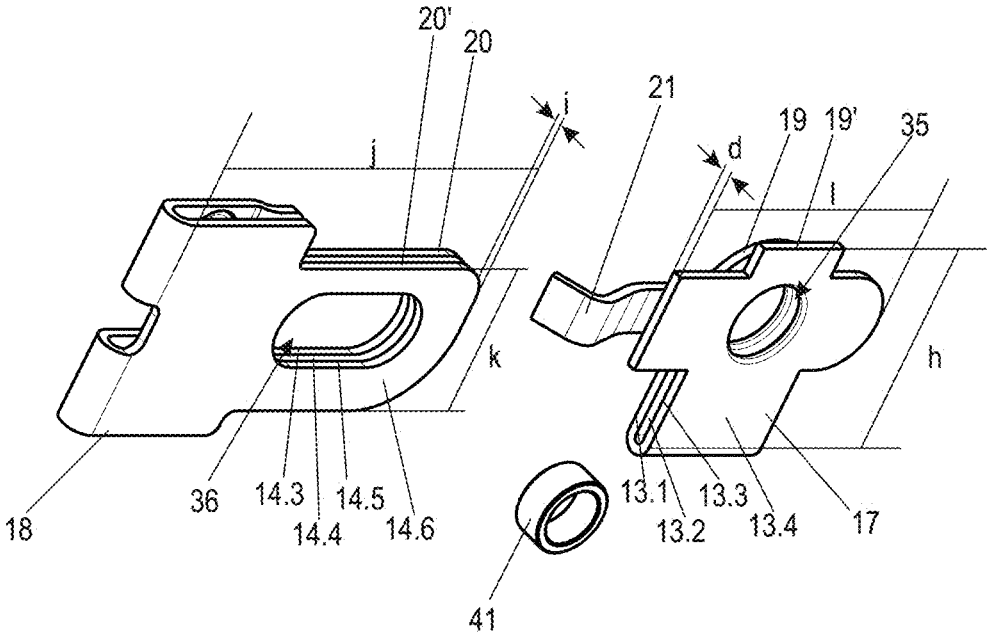
FIG. 10 shows a perspective exploded illustration of the clamping elements from FIG. 9.

FIGS. 9 and 10 show clamping elements 17 and 18 as are provided in the exemplary embodiments according to FIG. 1 or according to FIG. 4. In FIG. 9, the clamping elements 17, 18 are illustrated in an assembled state and in FIG. 10 in a disassembled state. As shown in FIGS. 9 and 10, the first clamping element 17 has two plates 19, 19' and the second clamping element 18 has two plates 20, 20'.

The first clamping element 17 is configured in one piece. The first clamping element 17 is formed from a folded sheet-metal element and has two plates 19, 19' which extend parallel to one another in the tensioned state. The plates 19, 19' each have two contact faces 13.1, 13.2, 13.3, 13.4. As FIG. 10 shows, the plates 19' located closer to the tensioning face 4 have a height h, a length l and a width d, wherein the width d is less than the height h and the length l. The length l is in this case measured parallel to the longitudinal direction 11 (FIG. 1), the width d is measured perpendicularly to the longitudinal plane 10 (FIG. 1), and the height h is measured perpendicularly to the longitudinal direction 11 and parallel to the longitudinal plane 10. The plates 19, 19' are approximately the same size. Through the first clamping element 17, there extends the opening 35, into which the sleeve 41 is fitted. The spring 21, which is formed on the plate 19, is configured as a sheet-metal strip, extends in the longitudinal direction 11 and has a bulge formed transversely to the longitudinal direction 11. During the bracing of the chainsaw 1, the spring 21 comes into contact with the screw head 43 of the screw 42 fastened in the housing 24 and braces the clamping element 17 with the sleeve 41 against the bolt 22 in the longitudinal direction 11. As a result, the clamping element 17 with the sleeve 41 is fastened to the bolt 22 in a play-free manner in the longitudinal direction 11.

As shown in FIGS. 9 and 10, the second clamping element 18 is likewise configured in one piece. The second clamping element 18 is formed from a folded sheet-metal element and has two plates 20, 20' which extend parallel to one another in the tensioned state. The plates 20, 20' each have two contact faces 14.2, 14.3, 14.4, 14.5. Both plates 20, 20' have a height k, a length j and a width i, wherein the width i is less than the height k and the length j. The width i of the plates 20, 20' of the second clamping element 18 corresponds to the width d of the plates 19, 19' of the first clamping element 17. The plates 20, 20' of the second clamping element are approximately the same size. Through the clamping element 18, there extends an opening 36, which is configured as a slot. The second clamping element 18 is fastened to the guide bar 28, screwed thereto in an advantageous embodiment. In the assembled state of the chainsaw 1, the bolt 22 projects through the opening 36 of the second clamping element 18. Since the opening 36 is configured as a slot, the second clamping element 18 can be shifted with the guide bar 28 in the longitudinal direction 11 with respect to the housing 24, and as a result the saw chain 7 can be tensioned. In the assembled state of the clamping elements 17, 18, the plates engage in one another in a lamellar manner and transmit forces between the guide bar 28 and the housing 24. In an advantageous embodiment, the clamping elements 17, 18 are made of stainless steel.

Figure 11:
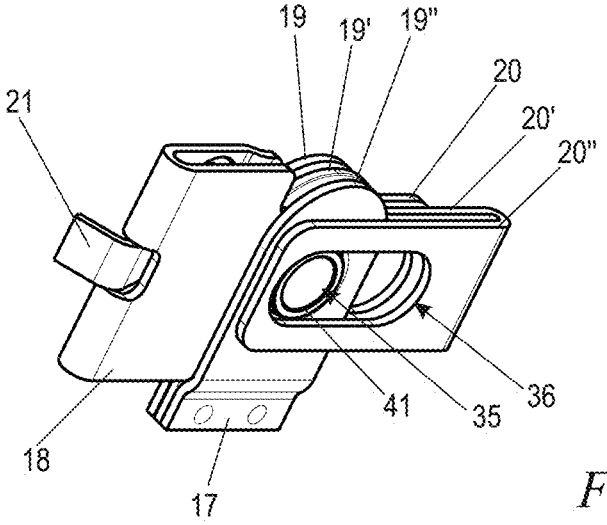
FIG. 11 shows a perspective illustration of clamping elements, engaging in one another, with three plates.
Figure 12:
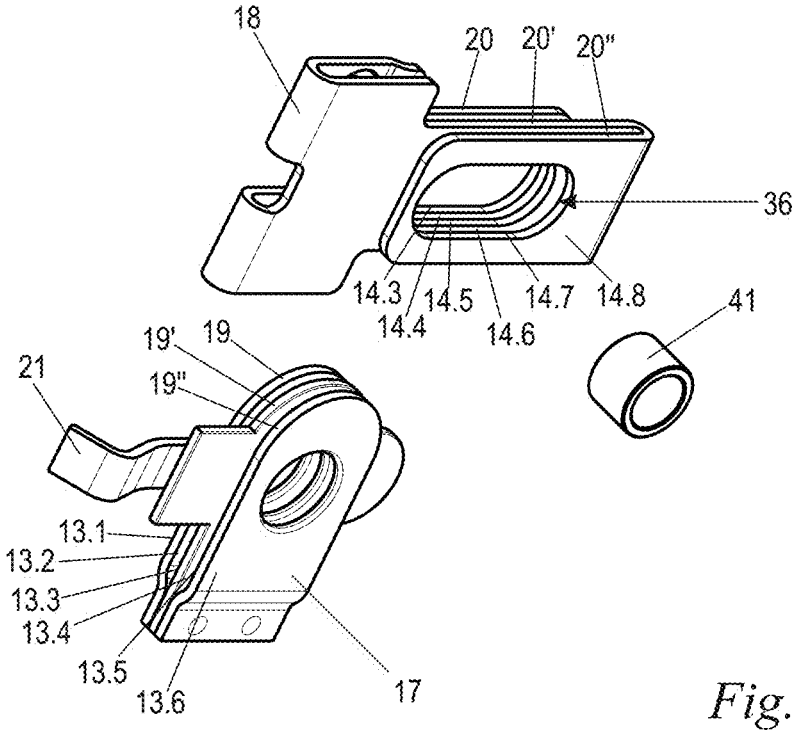
FIG. 12 shows a perspective exploded illustration of the clamping elements from FIG. 11.

The clamping elements 17, 18 shown in FIGS. 11 and 12 correspond to the above embodiments in FIGS. 9 and 10. In this case, the exemplary embodiments in FIGS. 11 and 12 differ from those in FIGS. 9 and 10 only in that the clamping elements 17, 18 each comprise three plates 19, 19', 19", 20, 20', 20". In the exemplary embodiment, the plates 19, 19', 19" are connected together by means of rivets, and in an alternative advantageous embodiment by means of screws. In an advantageous embodiment, the first clamping element 17 can also be formed in one piece in the form of a doubly folded metal sheet. The second clamping element 18 is formed in one piece as a doubly folded metal sheet. As a result of the additional plates 19", 20" of the clamping elements 17, 18, the force that is transmissible between the guide bar 28 and the housing 24 can be increased. Thus, with a low clamping force of the tensioning element 3, for example in the case of tool-free tensioning by the operator, a sufficiently high frictional force for securing the guide bar 28 to the housing 24 can nevertheless be achieved.

Figure 13:
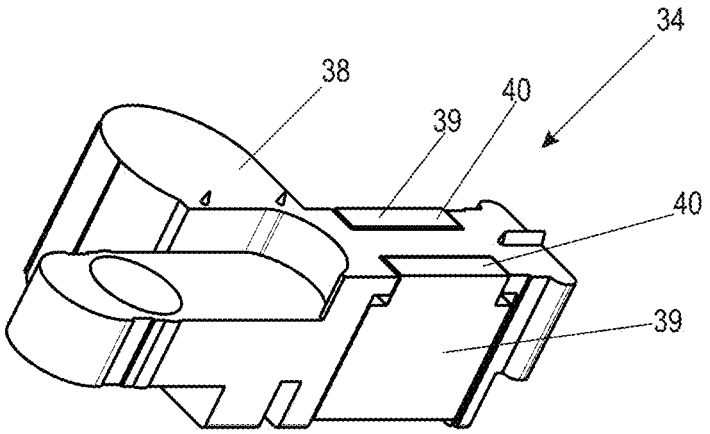
FIG. 13 shows a perspective illustration of a magnet retaining device.
Figure 14:
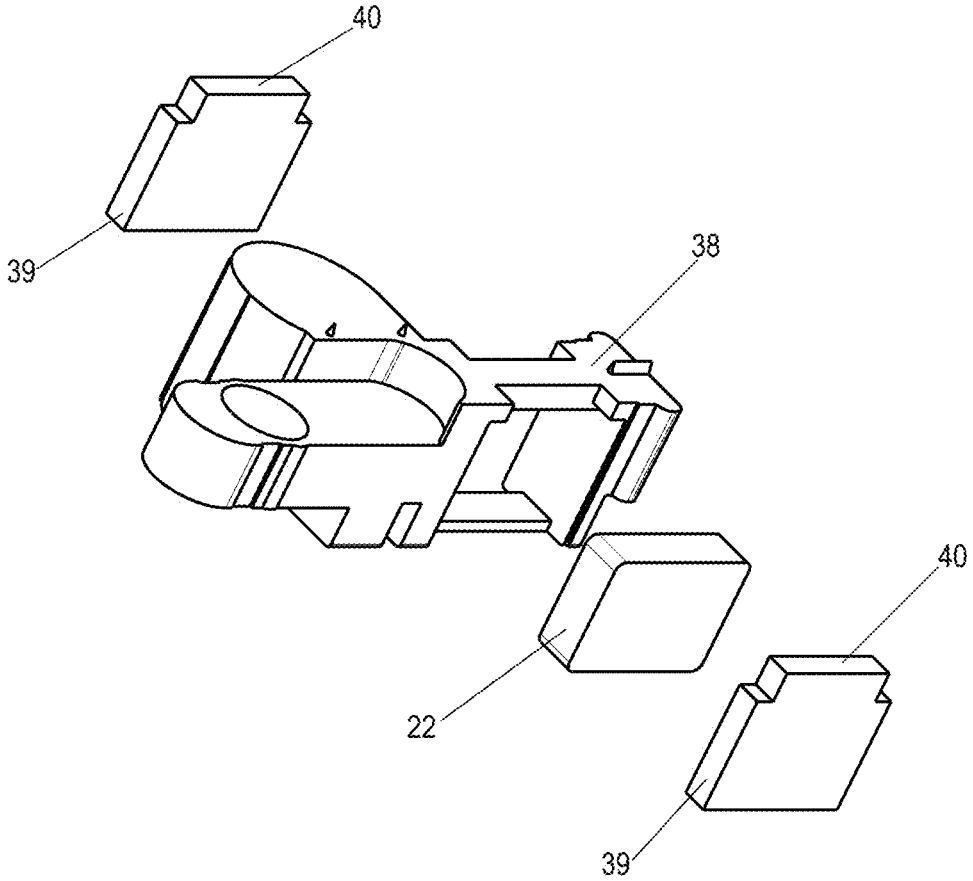
FIG. 14 shows a perspective exploded illustration of the magnet retaining device from FIG. 13.

In FIGS. 13 and 14, the magnet device 34 is shown, wherein the magnet device 34 is illustrated in the assembled state in FIG. 13 and in the disassembled state in FIG. 14. In the assembled state of the chainsaw 1, the magnet device 34 is retained on the housing 24, in an advantageous embodiment screwed to the housing 24, in particular adhesively bonded thereto. The magnet device 34 comprises a magnet-receiving element 38, two abutment plates 39, and a magnet 22 (see FIG. 14). The magnet 22 is arranged in the magnet-receiving element 38 and enclosed by the latter and by the abutment plates 39 fastened to the magnet-receiving element 38. In the exemplary embodiment, the magnet 22 and the abutment plates 39 are adhesively bonded to the magnet-receiving element 38, wherein, in an advantageous embodiment, other fastening methods are also possible. In an advantageous exemplary embodiment, the magnet device 34 is arranged on the housing 24 such that ends 40 of the abutment plates 39 that are directed toward the longitudinal plane 10 lie approximately in a plane with the abutment face 12 of the housing 24. If the guide bar 28 bears against the abutment face 12, it is in contact with the ends 40 of the abutment plates 39 and is also magnetically retained with the tensioning element 3 released. The magnet device 34 is advantageously designed such that it uses the installation space for a no longer required tensioning device for the saw chain 7, and preferably fills said installation space. In advantageous embodiments, other magnet devices or other retaining devices for retaining the guide bar 28 are also possible.

In order to tension the saw chain 7, the operator merely has to loosen the nut 16. As a result, the clamping forces that act on the guide bar 28 are reduced sufficiently for the operator to be able to pull the guide bar 28 manually forward, i.e. away from the housing 24, until the desired chain tension has been achieved. The magnet 22 retains the guide bar 28 in this position. The operator can then re-tighten the nut 16, and the saw chain 7 is tensioned. It is also the case that, during the assembly of the guide bar 28 on the housing 24, the magnet 22 retains the guide bar 28 in position until the housing cover 25 has been positioned and the nut 16 has been screwed on.

According to the invention, the guide bar 28 is secured to the fixed part 2 in a frictional manner. Form-fitting securing in the longitudinal direction 11 is not provided, and so the guide bar 28 can already be shifted in the longitudinal direction 11 with respect to the fixed part 2 after the nut 16 has been loosened a little, overcoming the frictional forces that still prevail.

Clamping elements 17, 18 according to the invention can advantageously be used in all types of chainsaws, i.e. in work apparatuses in which a saw chain 7 is driven in circulation about a guide bar 28. These also include for example pole pruners or the like. Use for securing other components may also be advantageous.

In a further advantageous exemplary embodiment, the chainsaw 1 has the movable part 8, wherein the movable part 8 comprises the guide bar 28 and the clamping element 18. The clamping element 18 is fastened to the guide bar 28 in a manner firmly connected to the guide bar 28 in the longitudinal direction 11. To this end, the clamping element 18 can have for example a peg which projects in a form-fitting manner into an opening of the guide bar 28. The chainsaw 1 additionally comprises the fixed part 2, wherein the fixed part 2 comprises the housing 24, the clamping element 17 and the housing cover 25. The clamping element 17 is fastened to the housing cover 25 in a manner firmly connected to the housing cover 25 in the longitudinal direction 11. In the assembled state of the guide bar 28, the guide bar 28 is retained between the housing cover 25 and the housing 24. Advantageously, the clamping elements 17 and 18 are preassembled on the housing cover 25 and are placed on the guide bar 28 with the housing cover 25 during the assembly of the housing cover 25. The clamping element 18 is advantageously connected firmly to the guide bar 25 in the longitudinal direction 11 of the guide bar 25 when the housing cover 25 is put in place.

While specific embodiments of the invention have been shown and described in detail to illustrate the inventive principles, it will be understood that the invention may be embodied otherwise without departing from such principles.

We claim:

1. A chainsaw, comprising: a guide bar; a saw chain that circulates on the guide bar; a drive motor that drives the saw chain circulating on the guide bar, wherein the chainsaw has a fixed part which comprises the drive motor, and wherein the chainsaw has a movable part which comprises the guide bar; a tensioning element arranged so that the guide bar is retained on the fixed part at one end braced between the fixed part and the tensioning element transversely to a longitudinal plane of the guide bar, wherein the movable part is shiftable in a longitudinal direction of the guide bar with respect to the fixed part to tension the saw chain with the tensioning element released; a stop face firmly connected to the fixed part in the longitudinal direction with the tensioning element released; and a tensioning face of the tensioning element, said tensioning face being firmly connected to the tensioning element in the longitudinal direction with the tensioning element released; at least two contact faces firmly connected to the movable part in the longitudinal direction with the tensioning element released, wherein one contact face of the at least two contact faces bears against the stop face and a further contact face of the at least two contact faces bears against the tensioning face; and at least one additional contact face firmly connected to the fixed part in the longitudinal direction with the tensioning element released arranged between the stop face and the tensioning face and at least one additional contact face firmly connected to the movable part in the longitudinal direction with the tensioning element released arranged between the stop face and the tensioning face, wherein all of the contact faces lie in succession in a flux of force from the tensioning element to the fixed part, further comprising at least one first clamping element and a second clamping element, wherein the at least one contact face that is firmly connected to the fixed part in the longitudinal direction with the tensioning element released is formed on the first clamping element and the at least one additional contact face that is firmly connected to the movable part in the longitudinal direction with the tensioning element released is formed on the second clamping element, wherein the clamping elements each comprise at least two plates extending parallel to the longitudinal plane, and in that the at least two plates of the first clamping element and the at least two plates of the second clamping element engage in one another in a lamellar manner.

2. The chainsaw according to claim 1, wherein the contact faces and the at least one additional contact face firmly connected to the movable part with the tensioning element released and the at least one additional contact face firmly connected to the fixed part with the tensioning element released together total at least four contact faces that are arranged between the contact faces of the stop face and the tensioning face.

3. The chainsaw according to claim 2, wherein the total contact faces includes at least eight contact faces arranged between the stop face and the tensioning face.

4. The chainsaw according to claim 1, wherein the contact faces extend parallel to the longitudinal plane of the guide bar with the tensioning element tensioned.

5. The chainsaw according to claim 1, wherein the contact faces are arranged alongside one another in a section plane perpendicular to the longitudinal plane.

6. The chainsaw according to claim 1, wherein the clamping elements each comprise at least one plate extending parallel to the longitudinal plane.

7. The chainsaw according to claim 6, wherein the plates of the clamping elements have a width in each case that is less than a length and a height of the plates.

8. The chainsaw according to claim 6, wherein the plates are resilient.

9. The chainsaw according to claim 1, wherein the first clamping element and/or the second clamping element are folded.

10. The chainsaw according to claim 1, wherein the first clamping element and/or the second clamping element are is made of stainless steel.

11. The chainsaw according to claim 1, further comprising a bolt that projects through the first clamping element and securely retains the first clamping element on the fixed part in the longitudinal direction.

12. The chainsaw according to claim 1, further comprising a spring arranged to retain the first clamping element on the fixed part in a play-free manner in the longitudinal direction.

13. The chainsaw according to claim 1, further comprising a magnet arranged in the fixed part so as to retain the movable part on the fixed part with the tensioning element released.

14. A chainsaw, comprising: a guide bar; a saw chain that circulates on the guide bar; a drive motor that drives the saw chain circulating on the guide bar, wherein the chainsaw has a fixed part which comprises the drive motor, and wherein the chainsaw has a movable part which comprises the guide bar; a tensioning element arranged so that the guide bar is retained on the fixed part at one end braced between the fixed part and the tensioning element transversely to a longitudinal plane of the guide bar, wherein the movable part is shiftable in a longitudinal direction of the guide bar with respect to the fixed part to tension the saw chain with the tensioning element released; a stop face firmly connected to the fixed part in the longitudinal direction with the tensioning element released; and a tensioning face of the tensioning element, said tensioning face being firmly connected to the tensioning element in the longitudinal direction with the tensioning element released; at least two contact faces firmly connected to the movable part in the longitudinal direction with the tensioning element released, wherein one contact face of the at least two contact faces bears against the stop face and a further contact face of the at least two contact faces bears against the tensioning face; and at least one additional contact face firmly connected to the fixed part in the longitudinal direction with the tensioning element released arranged between the stop face and the tensioning face and at least one additional contact face firmly connected to the movable part in the longitudinal direction with the tensioning element released arranged between the stop face and the tensioning face, wherein all of the contact faces lie in succession in a flux of force from the tensioning element to the fixed part, further comprising at least one first clamping element and a second clamping element, wherein the at least one contact face that is firmly connected to the fixed part in the longitudinal direction with the tensioning element released is formed on the first clamping element and the at least one additional contact face that is firmly connected to the movable part in the longitudinal direction with the tensioning element released is formed on the second clamping element, wherein the clamping elements each have a width measured perpendicularly to the longitudinal plane, wherein the width of the clamping elements with the tensioning element released is in each case greater than the width of the clamping elements with the tensioning element tensioned.

* * * * *